US005745133A

United States Patent [19]

Hendricks et al.

[11] Patent Number: 5,745,133

[45] Date of Patent: Apr. 28, 1998

[54] DUAL PIVOTING WIPER SYSTEM FOR INKJET PRINTHEADS

[75] Inventors: Jeffrey T. Hendricks, Camas, Wash.; Kris M. English, Portland, Oreg.

[73] Assignee: Hewlett-Packard Company, Palo Alto, Calif.

[21] Appl. No.: 558,561

[22] Filed: Oct. 31, 1995

[51] Int. Cl.[6] ..... B41J 2/165

[52] U.S. Cl. ..... 347/33

[58] Field of Search ..... 347/33

[56] References Cited

U.S. PATENT DOCUMENTS

| | | | |
|---|---|---|---|
| 5,252,993 | 10/1993 | Tomii et al. | 346/140 R |
| 5,394,178 | 2/1995 | Grange | 347/32 |
| 5,559,539 | 9/1996 | Vo et al. | 347/33 |
| 5,612,721 | 3/1997 | Ishize | 347/33 |
| 5,644,345 | 7/1997 | Toniolo | 347/33 |

FOREIGN PATENT DOCUMENTS 2-202452 1/1990 Japan .

*Primary Examiner*—Stuart N. Hecker
*Attorney, Agent, or Firm*—Flory L. Martin

[57] ABSTRACT

A dual pivoting wiper system cleans the nozzle face plate of an inkjet printhead, particularly one that dispenses a pigment based ink. An inkjet printing mechanism has a printhead service station including a sled that moves from a rest position to a wiping position. The wiping system includes a support arm with proximate and distal ends, with the proximate end pivoted to the sled and the distal end pivotally supporting an upright wiper blade. The arm is spring-biased to push the wiper blade into engagement with the printhead. During wiping, the printhead is engaged by wiper blade and the blade remains relatively upright. Any spacing variations between the printhead and the sled are accommodated by spring flexure, and any lack of parallelism of the printhead from a nominal plane is primarily accommodated by pivoting of the blade at the distal end of the support arm.

30 Claims, 5 Drawing Sheets

DUAL PIVOTING WIPER SYSTEM FOR INKJET PRINTHEADS

FIELD OF THE INVENTION

The present invention relates generally to inkjet printing mechanisms, and more particularly to a dual pivoting wiper system that cleans the nozzle face plate of an inkjet printhead that dispenses a pigment based ink.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. These pigment based inks require a higher wiping force than that previously needed for dye based inks. Yet, there is an upper limit to the wiping force because excessive forces may damage the orifice plate. Thus, a delicate balance is required in wiper design, which is capable of adequately cleaning the orifice plate to maintain print quality, while avoiding damage to the nozzle plate itself.

The previous wiping solutions used a cantilever wiping approach. In cantilever wiping, a flexible low durometer elastomeric blade is supported at its base by a sled. While the sled may be stationary, in many designs it was moveable so the sled could travel to a position where the wipers would engage the nozzle plate. Wiping was accomplished through relative motion of the wipers with respect to the nozzle plate, by either moving the wiper relative to a stationary nozzle plate, or more typically, by moving the nozzle plate relative to a stationary wiper.

The flexibility of the cantilever wiper accommodated for variations in the distance between the nozzle plate and sled, also referred to as variations in the "interference" between the wiper and nozzle plate. That is, for a closer sled-to-nozzle spacing (or a "greater interference"), the wiper flexed more than it would for a larger spacing. The force transmitted to the face plate was determined by the degree of bending of the wiper blade, as well as by the stiffness of the wiper blade material.

The stiffness of the wiper blade is a function of the geometry of the blade and of the material selected. For instance, one common measure of elastomeric flexibility (tested using a sample of a standard size) is known as the "durometer," including a variety of scales known to those skilled in the art, such as the Shore A durometer scale.

Unfortunately, the manufacture of elastomers is not as exacting as that of metals. To some extent, the composition of elastomeric materials remains more of an art than a science. Often, it is very difficult to exactly duplicate the material composition from one batch to the next. Hence, in a practical context, a fairly wide tolerance variation must be used in a wiper's durometer specification. Thus, the force transmitted to the printhead face plate in a practical wiper may vary, not only due to tolerance variations in the service station components, but also due to material variations in the elastomeric material of the wiper blade.

With the earlier dye based inks, the bending of the soft cantilever wiper accommodated a variety of accumulated manufacturing tolerances. The earlier wiper positioning mechanisms, such as sled and ramp systems, rack and pinion gear systems, and rotary systems, all have mechanical parts that are manufactured within certain tolerances. These tolerances may accumulate in any given unit to generate maximum or minimum pen-to-sled spacing variations. Furthermore, a replaceable inkjet cartridge and the printing mechanism carriage each have their own tolerance variations. Other variations are introduced by any imprecision in fitting the cartridge to the carriage, such as when an operator installs a fresh cartridge.

FIGS. 6, 7 and 8 are schematic front elevational views illustrating operation of the prior art cantilever blade wiping system. In these figures, the orifice or nozzle plate A of an inkjet printhead P is being wiped by a cantilever wiper blade B. The wiper blade B is mounted at its base to a sled C to accomplish the wiping, either by moving the sled C to the left, or by moving the pen orifice plate A to the right. FIG. 6 illustrates a high interference fit where the orifice plate A and sled C are separated by a short distance X, while FIG. 7, shows the separation as distance Y for a nominal interference, and FIG. 8 shows the separation as distance Z for a low interference fit (X<Y<Z). For the high interference fit, a very small contact angle $\phi 1$ is shown in FIG. 6, while a nominal contact angle $\phi 2$ is shown in FIG. 7, and a much larger contact angle $\phi 3$ is shown in FIG. 8 ($\phi 1<\phi 2<\phi 3$). These varying contact angles also produce variations in the wiping force applied to the printhead, with the arrangement of FIG. 6 showing a high wiping force, FIG. 7 showing a nominal wiping force, and FIG. 8 showing a low wiping force.

Cantilever based wiping systems proved merely adequate, not ideal, for wiping printheads using dye based inks. When used with pigment based ink cartridges, the cantilever wiper blades proved woefully inadequate for removing the debris accumulated on the nozzle face plates. In either case, one proposed solution involved stiffening the cantilever blade by increasing the durometer of the elastomer. Unfortunately, stiffening the cantilever blade produced excessive wiping forces at close sled-to-pen spacings, which in the extreme case could damage the nozzle face plate.

SUMMARY OF THE INVENTION

According to one aspect of the present invention a wiping apparatus is provided for cleaning an inkjet printhead installed in an inkjet printing mechanism having a frame. The wiping apparatus has an upright wiper blade and a support structure that joins the wiper blade to the printing mechanism frame for a rocking motion of the blade with respect to the frame. The wiping apparatus also has a biasing element coupled to the support structure and the printing mechanism frame to push the wiper into engagement with the printhead.

According to another aspect of the present invention a servicing apparatus is provided for maintaining an inkjet printhead installed in an inkjet printing mechanism having a frame. The servicing apparatus has a sled coupled to the printing mechanism frame to selectively service the printhead. The servicing apparatus also has a wiper to wipe the installed inkjet printhead. A wiper support structure is pivoted to the sled and pivoted to the wiper to selectively wipe the printhead with the wiper.

According to a further aspect of the present invention a servicing apparatus includes a sled coupled to the printing mechanism frame for movement from a rest position to a wiping position. The servicing apparatus further includes a support arm with proximate and distal ends. The proximate end of the support arm is pivoted to the sled. The servicing apparatus also has a wiper pivoted to the support arm distal end to engage and wipe the printhead when the sled is moved into the wiping position.

According to an additional aspect of the present invention an inkjet printing mechanism is provided with the wiping or servicing apparatus described above.

According to another aspect of the present invention, a method of cleaning an inkjet printhead installed in an inkjet printing mechanism includes the step of positioning the printhead and an upright wiper blade into mutual engagement. In a wiping step, through relative movement of the printhead and the wiper blade, the wiper blade wipes the printhead. In a pushing step, the upright wiper blade is pushed toward the printhead during the wiping step. In an illustrated embodiment, the method further includes the step of, during the wiping step, accommodating for any spacing variations of the printhead from a nominal spacing distance and for any tilting of the printhead from a nominal planar orientation.

An overall goal of the present invention is to provide an inkjet printing mechanism which prints sharp vivid images, particularly when using fast drying pigment or dye based inks.

Another goal of the present invention is to provide a robust wiping system capable of reliably cleaning the nozzle face plate of an inkjet printhead, whether containing a dye-based ink or a pigment-based ink.

DETAILED DESCRIPTION OF THE PREFERRED EMBODIMENTS

Figure 1:
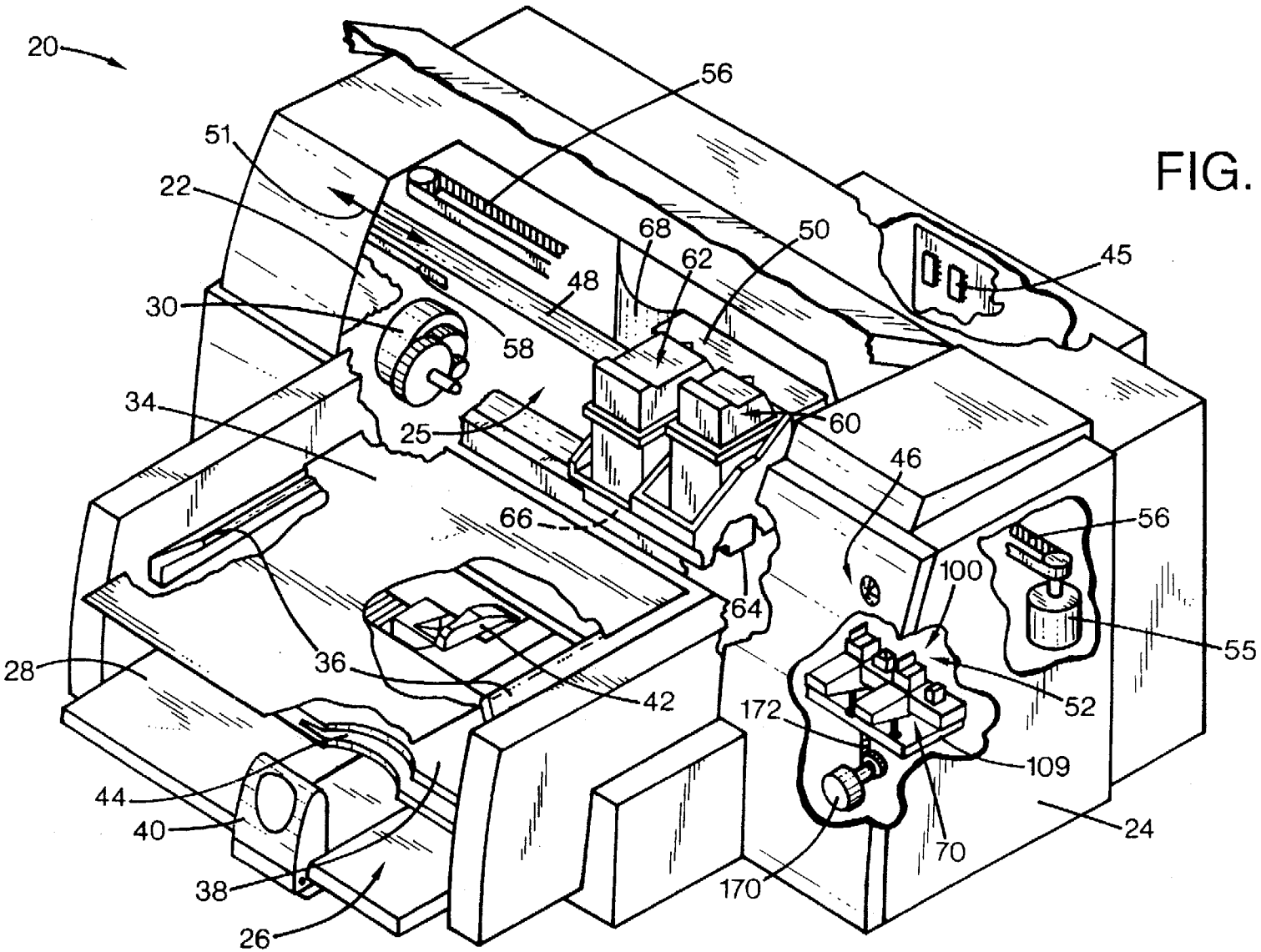
FIG. 1 is a fragmented, partially schematic, perspective view of one form of an inkjet printing mechanism having a dual pivoting wiper system of the present invention for servicing an inkjet printhead.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a stepper motor and drive gear assembly 30, may be used to move the print media from tray 28 into the print zone 25, as shown for sheet 34, for printing. After printing, the motor and drive gear assembly 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a dual inkjet pen carriage system 50 for travel back and forth across the print zone 25 along a scanning axis 51. The carriage 50 is also propelled along guide rod 48 into a servicing region, as indicated generally by arrow 52, located within the interior of the housing 24. A carriage drive gear and DC motor assembly 55 is coupled to drive an endless belt 56. The motor 55 operates in response to control signals received from the controller 45. The belt 56 may be secured in a conventional manner to the carriage 50 to incrementally advance the carriage along guide rod 48 in response to rotation of motor 55.

To provide carriage positional feedback information to printer controller 45, an encoder strip 58 extends along the length of the print zone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art.

In the print zone 25, the media sheet 34 receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink therein. The pens 60, 62 have printheads 64, 66 respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multi-conductor strip 68 from the controller 45 to the printhead carriage 50.

Dual Pivoting Wiper System

Figure 2:
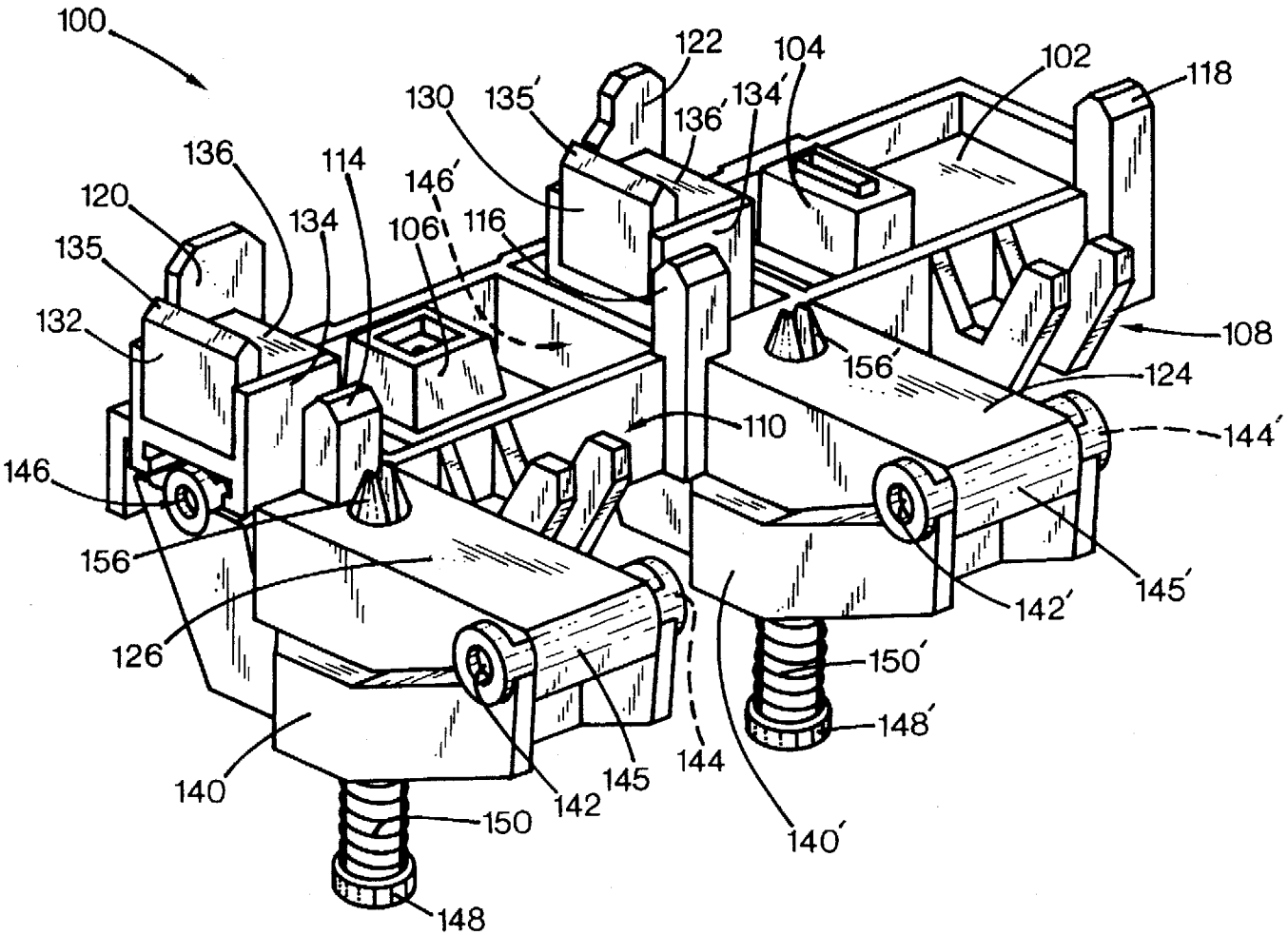
FIG. 2 is a perspective view of the dual pivoting wiper system of FIG. 1.
Figure 3:
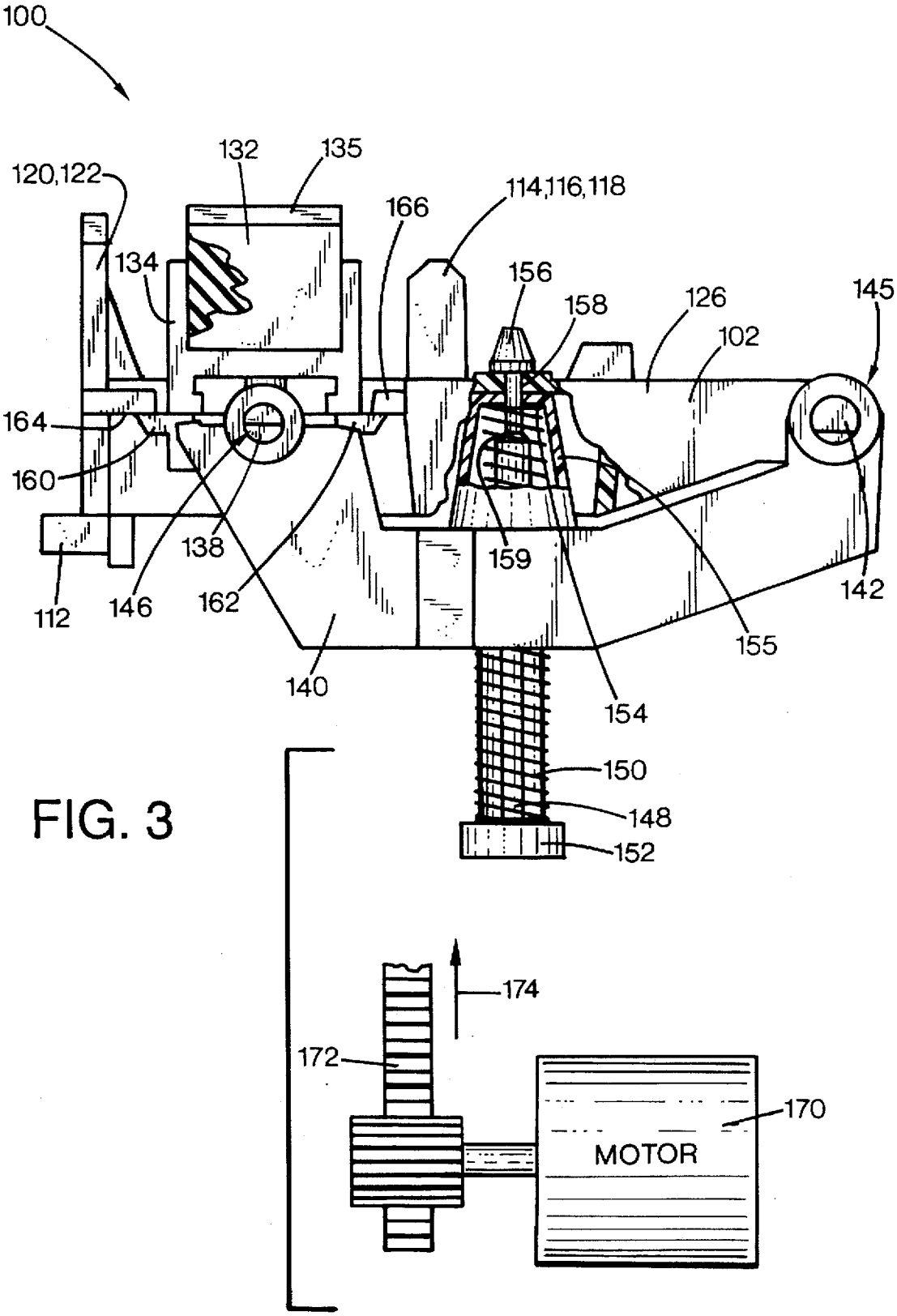
FIG. 3 is a side elevational view of the dual pivoting wiper system of FIG. 1, shown in a rest position for printing.

FIGS. 2 and 3 show one embodiment of a printhead service station 70 that resides within the servicing region 52 of the printer enclosure 24. The service station 70 includes a dual pivoting wiper system 100 constructed in accordance with the present invention for servicing the inkjet cartridges 60, 62. The wiper system 100 is illustrated as being an integral part of a pen capping and wiping system, including a sled 102 that supports various servicing implements. The sled 102 supports a black printhead cap 104 and a color printhead cap 106, for substantially sealing the respective black and color printheads 64, 66 during periods of printing inactivity. The caps 104, 106 may be of any conventional design.

The sled 102 may be moved into various servicing position using a variety of different elevating mechanisms known to those skilled in the art, several of which are discussed further below. To assist in coupling the sled 102 to a base unit 109 coupled to such an elevating mechanism (not shown), the sled includes two sets of mounting arms 108, 110 (FIG. 2), and a rear mounting member 112 (FIG. 3). To assist in aligning the servicing components with the cartridges 60, 62, the sled 102 includes three alignment members 114, 116 and 118 located toward the front of the printer 20, and two rear alignment members 120, 122 located toward the rear of the sled 102.

The sled 102 has two support arms 124, 126 which extend forwardly from the main body of the sled. The dual wiper system 100 includes a black wiper 130 and a color wiper 132 for wiping printheads 64, 66, respectively. The wipers 130, 132 are preferably of a resilient, non-abrasive, elastomeric material, such as nitrile rubber, or more preferably ethylene polypropylene diene monomer (EPDM), or other comparable materials known in the art. In a preferred embodiment, the durometer of the EPDM wiper material is selected between the range of 40–100, on the Shore A scale, with a more preferred range being between 85–95, with a preferred nominal value being about 90, plus or minus a standard tolerance, such as ±5. It is apparent that the wipers 130, 132 may be made of different materials, or of materials having different durometers. However, to simplify manufacturing procedures, and to reduce the number of different parts required to assemble the printer 20, preferably the wipers 130 and 132 are of the same material and construction. For the same reasons, the manner of attaching the wipers 130, 132 to the sled 102 is preferably also the same. Thus, in describing the illustrated embodiment of attaching the wipers 130 and 132 to the sled 102, the components will be described with respect to the color wiper 132, and with similar parts for the black wiper 130 which are visible in the drawings being indicated with the same item number primed (′). For example, item number 134 is a stem portion which receives wiper 132, whereas item number 134′ will be used to indicate the stem which receives wiper 130.

Thus, the illustrated wipers 132, 130 each include an upright wiper blade portion 135, 135′ which is integrally formed with a block mounting portion 136, 136′.

Each wiper blade 135, 135' has two opposing sides which taper into a peaked wiping edge that engages the respective printheads 66, 64. The wiper blades 135, 135' and the block portions 136, 136' are seated within the stem portion 134, 134'. The wiper stem 134, 134' has a pair of pivot posts, such as pivot post 138 (FIG. 3) which is pivotally received by a distal end of a wiper support arm 140, 140'. The wiper arm 140 has a proximate end supported by a pair of pivot posts 142 and 144 which extend outwardly from each side of the support arm 126 for supporting the color wiper 132. The wiper arm 140' is similarly supported by a pair of pivot posts 142' and 144' which extend outwardly from each side of the support arm 124 for supporting the black wiper 130. The pivot posts 142, 144 and 142', 144' define what is referred to herein as an elbow joint 145, 145', whereas the pivot posts 138 define a wrist joint, such as joint 146.

To bias the wiper arm 140 toward the sled 102, the dual pivoting wiper system 100 includes a biasing element or member, here illustrated as a retainer 148, 148' and a compression coil spring 150, 150'. Preferably, spring 150, 150' is selected to have a preferred spring rate of 0.05–0.15 N/mm (Newtons per millimeter), or more preferably a spring rate of 0.05–0.10 N/mm, and a preferred force of 0.4–0.8 N, or more preferably a force of 0.5–0.65 N both at a compressed length of approximately 27 mm, and at a free length of approximately 36 mm. One end of spring 150, 150' is retained by a lip 152 at the base of retainer 148. As best shown in FIG. 3, the other end of spring 150 is received within a pocket 154 defined by an upward protuberance 155 extending upwardly from arm 140. The spring retainer 148 has a distal end 156, 156' which extends through a hole 158 defined by and extending through support arm 126. Preferably, this is a loose fit which allows the retainer 148 to toggle and rock in hole 158 as arm 140 pivots and during wiping.

To limit the downward motion of wipers 130, 132, the retainer 148, 148' has a shoulder portion 159 which engages the end of the pocket 154. Thus, downward motion of the wiper arm 140, 140' compresses the spring 150, 150' until the end of pocket 154 hits the retainer shoulder 159. Other biasing elements may also be used, for instance, a leaf spring (not shown) coupling the arm 140, 140' to the sled 102, or a torsional spring (not shown) located at the elbow joint 145, 145'. To limit the upward motion of the wipers 130, 132, the wiper stem 134, 134' includes a pair of prealignment features, such as projections, shelves or tabs 160, 162 which extend outwardly to engage a pair of engagement members, such as protuberances, abutments or stops 164, 166, respectively, extending from the sled 102. The wiper blades 130, 132 are advantageously held at an initial nominal position by engagement of the tabs 160, 162 with the respective stops 164, 166 before engaging the printheads 64, 66.

Figure 4:
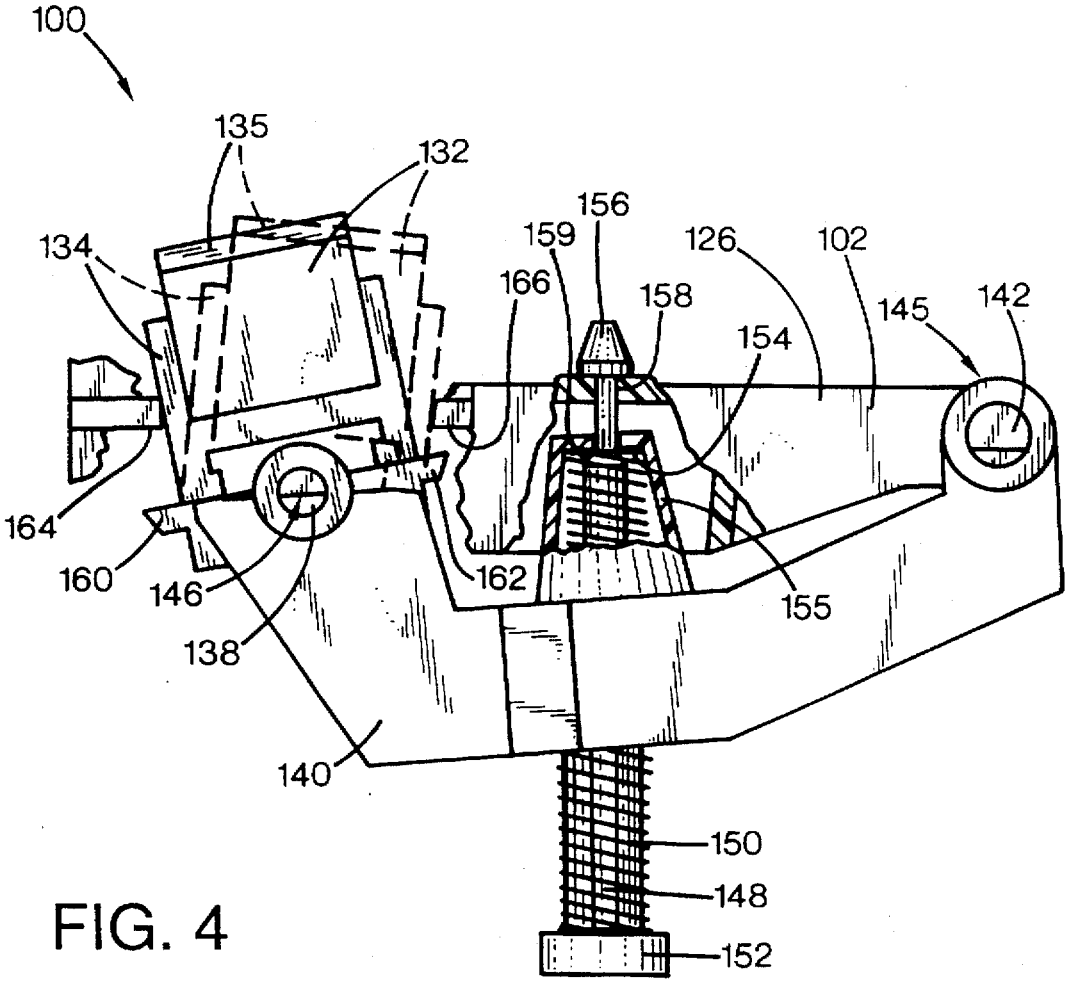
FIG. 4 is a side elevational view of the dual pivoting wiper system of FIG. 1, shown in the two extreme tilted positions, with one position shown in solid lines and the other shown in dashed lines.
Figure 5:
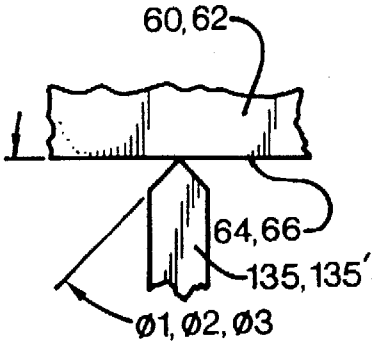
FIG. 5 is a schematic, front elevational view of the contact angle of the dual pivoting wiper system of FIG. 1, which maintains a relatively constant angle of attack with respect to the pen orifice plate at high interference, nominal interference and low interference conditions.

FIG. 4 shows the dual pivoting wiper system 100 at the most extreme positions for accommodating variations in the relative alignment of the printheads 64, 66 with respect to sled 102, and of course, with respect to the printer frame or chassis 22. In FIG. 4, spring 150 is compressed to its maximum amount, with the end of the arm pocket 154 hitting the retainer shoulder 159. The position of FIG. 4 accommodates a close printhead to sled spacing (high interference) when the wiper blade 135, 135' is engaged by the printhead 66, 64 (FIGS. 1 and 5). Other pen-to-sled spacings are accommodated by spring compressions between those shown in FIGS. 3 and 4.

If the face plate of the printhead 66, 64 is crooked with respect to sled 102, hat is, tilted or offset from front to rear (perpendicular with the scanning axis 51) of plane parallel with the sled, then flexure of the wrist joint 146 automatically aligns the peaked wiping edge of blade 135 parallel to the face plate. FIG. 4 shows the maximum rearward flexure of blade 135 in solid lines, and the maximum forward flexure in dashed lines. Preferably, the wiper blades 130, 132 are initially held at a nominal position by engagement of the tabs 160, 162 with the respective stops 164, 166 before engaging the printheads 64, 66. Then after engagement, the wrist joint 146, 146' flexes preferably only about 1° either toward the front or back of the printer to accommodate any misalignment of the printhead with respect to the sled. It is apparent that any given embodiment of the dual pivoting wiper system may be modified to accommodate other angles of printhead-to-sled misalignment, and the 1° value (as well as other component values given herein) is only given to describe the illustrated preferred embodiment. As the wiper blade 135, 135' moves across the printhead (either by moving the wiper, or as shown here, by moving the printhead), the wrist joint 146, 146' can flex to maintain contact across the entire width of the face plate.

Figure 6:
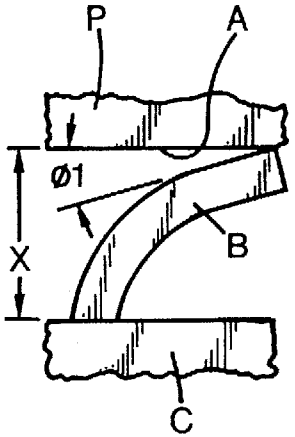
FIG. 6 Prior Art
FIG. 6 is a schematic, front elevational view of the contact angle a prior art cantilever wiping blade, shown wiping a nozzle plate positioned for high interference.
Figure 7:
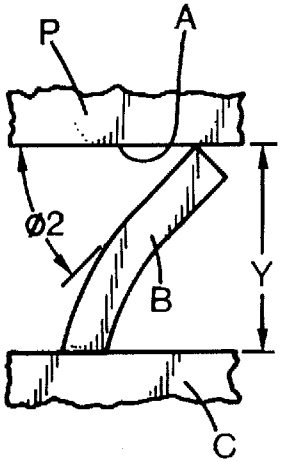
FIG. 7 Prior Art
FIG. 7 is a schematic, front elevational view of the prior art cantilever wiping blade of FIG. 6, shown wiping a nozzle plate positioned for nominal interference.
Figure 8:
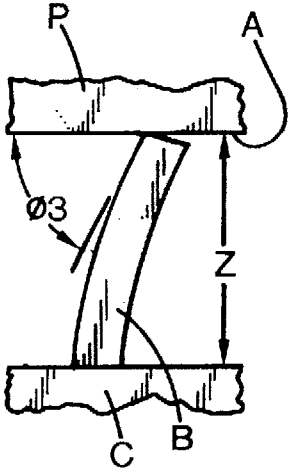
FIG. 8 Prior Art
FIG. 8 is a schematic, front elevational view of the prior art cantilever wiping blade of FIG. 6, shown wiping a nozzle plate positioned for low interference.

By maintaining this dual pivoting action of joints 145, 145' and 146, 146' within a single plane (parallel with the sheet of paper in FIGS. 3 and 4), the wiper blade 135, 135' remains in a substantially upright alignment for wiping the respective printheads 66, 64, as shown in FIG. 5. FIGS. 6, 7 and 8 show the prior art cantilever wiping blade for high interference (X), nominal interference (Y), and low (Z) interference, which yielded wide variations in the contact angle $\phi 1$, $\phi 2$, and $\phi 3$, respectively. As shown in FIG. 5, the contact angle remains the same, independent of the interference with: $\phi 1$ indicating a high interference (close spacing), where the spring 150 would be at maximum compression; $\phi 2$ indicating a nominal interference where the printhead is located at a desired nominal distance from the sled 102; and $\phi 3$ indicating a low interference (larger printhead to sled spacing), where the spring 150 is only compressed minimally. Regardless of the degree of spacing between the printheads 64, 66 and sled 102, the dual wiping system 100 compensates for these variations, as well as for any lack of parallelism therebetween. Moreover, if the printhead also is canted from side-to-side (parallel with the scanning axis 51), the dual wiping system automatically accommodates for this circumstance by just changing the compression of the spring 150, 150' as the printhead 66, 64 is moved over the wiper 132, 130.

In operation, during printing the sled 102 of the service station 70 is at a rest position, lowered away from the path of printhead travel. In this rest position, the spring 150, 150' preferably pre-loads the wiper arm 140, 140' to force the tabs 160, 162 of stems 134, 134' into contact with the sled stops 164, 166, respectively. To initiate servicing, a service station motor 170 (FIGS. 1 and 4) moves the sled 102, preferably via a conventional rack and pinion gear mechanism 172, toward the printheads, in the direction indicated by arrow 174. The sled 102 is coupled to the rack and pinion gear mechanism 172 by the base unit 109, shown schematically in FIG. 1. The gear mechanism 172 and base unit 109 may be constructed in any conventional manner to move the wipers 130, 132 into engagement with the respective printheads 64, 66, for instance, by using the mechanism shown in U.S. Pat. No. 5,155,497, assigned to the present assignee, Hewlett-Packard Company. Other mechanisms may also be used to move the sled 102 into a wiping position, such as by moving the sled 102 laterally up a ramp (not shown) the concepts expressed in U.S. Pat. No. 5,440,331, also assigned to the present assignee, Hewlett-Packard Company.

Initially the wiper blades 130, 132 are held at a nominal or rest position by engagement of the tabs 160, 162 with the respective stops 164, 166, as shown in FIGS. 2 and 3, which advantageously minimizes wiper to printhead misalignment. Upon engaging the wipers 130, 132 with the printheads 64, 66, the biasing springs 150, 150' are compressed as the arm 140, 140' rocks downward, pivoting at elbow joint 145, 145'. This downward pivoting at elbows 145, 145' allows the wiper stem 134, 134' to pivot at wrist joint 146, 146' to rock the edges of the wiper blades 135, 135' into full engagement with each printhead 66, 64. Thus, the rocking of the wiper blade 135, 135' at wrist joint 146, 146' allows the wiper to accommodate for any angular misalignment between the wiper and printheads 64, 66. Pivoting at the elbow joints 145, 145' compensates for printhead to sled spacing variations. These angular and spacing variations may be caused part tolerance accumulations, or less than optimal pen seating in carriage 50, as discussed at length in the Background portion above.

As shown in FIG. 5, during wiping the upright structure of blade 135, 135' remains at a substantially constant angle with respect to the printheads 64, 66. In practicality, there is very little bending of the blade 135, 135' with respect to the stem 134, 134' during wiping, due to the downward motion of arm 140, 140'. During wiping, the wiper load increases the force applied to the spring 150, 150' over the initial pre-load force used to bias the wiper into a seated position (FIG. 3).

The spring 150, 150' pushes or urges the wiper blade 135, 135' into constant engagement with the printhead 66, 64 at a force which may be varied by selecting the spring with a particular rate and force. In this manner, the wiping force applied to the printhead is no longer a function of the degree of interference fit and wiper composition, as in the past with the cantilever wiping systems. Instead, the wiping force applied by the blade 135, 135' to the printhead 66, 64 is now controlled by the characteristics of the selected spring 150, 150'. This is particularly advantageous because springs have characteristics which are inherently more repeatable, resulting in small manufacturing tolerance deviations.

Conclusion

Thus, it is clear that the dual pivoting wiper system 100 improves the wiper-to-pen orifice plate alignment over that possible with the cantilever blade wiping system shown in FIGS. 6 through 8. Typically, reciprocating printheads have their nozzles aligned in at least one, but more preferably two, linear arrays each aligned perpendicular to the scanning axis 51. In the illustrated embodiment, the wipers 130, 132 wipe across first one nozzle array then across the second array of each printhead 64, 66. In other implementations, it may be more desirable to orient the dual pivoting wiper system 100 so blades 135, 135' wipe along the length of the nozzle arrays, here, perpendicular to scanning axis 51. Furthermore, while two discrete pens 60, 62 are shown, the dual pivoting wiper system 100 may also be used to wipe a page-wide array of printhead nozzles (not shown) extending across the printzone 25, for instance, by moving sled 102 along the length of such a page-wide nozzle array.

One important advantage realized using the dual pivoting wiper system 100 is the equalized alignment and force distribution of the wiper's engagement with the orifice plates of printheads 64, 66. Advantageously, the dual pivoting wiper system 100 reduces variations in wiping force which are inherent in commercially manufactured inkjet printers due to the various part tolerances and material variations accumulating, as well as variations due to pens which may be slightly misseated within the carriage 50. Moreover, by minimizing contact angle variation, as shown in FIG. 5, a more consistent wiping force is applied across the entire printhead. Thus, a more consistent wiping action is achieve throughout the life of the printer 20.

We claim:

1. A wiping apparatus for cleaning an inkjet printhead installed in an inkjet printing mechanism having a frame, comprising:

an upright wiper blade, wherein the wiper blade has a blade portion with two opposing side surfaces which taper into a peaked wiping edge that engages; the printhead;

a support structure joining the wiper blade to the printing mechanism frame for a rocking motion of the blade with respect to the frame; and a biasing element coupled to the support structure and the printing mechanism frame to push the wiper into engagement with the printhead.

2. A wiping apparatus according to claim 1, wherein the support structure joins the wiper blade to the printing mechanism frame for a rocking motion which is substantially planar.

3. A wiping apparatus according to claim 1, wherein the support structure further includes:

a first coupling portion that moves the wiper blade toward the printhead to accommodate any spacing variations of an installed printhead from a nominal spacing distance; and a second coupling portion that tilts the wiper blade to accommodate any tilting of an installed printhead from a nominal planar orientation.

4. A wiping apparatus according to claim 3, wherein the biasing element is coupled to the support structure between the first coupling portion and the second coupling portion.

5. A wiping apparatus according to claim 1, wherein the wiper blade remains substantially upright when pushed into engagement with the printhead.

6. A wiping apparatus for cleaning an inkjet printhead installed in an inkjet printing mechanism having a frame, comprising:

an upright wiper blade;

a support structure joining the wiper blade to the printing mechanism frame for a rocking motion of the blade with respect to the frame, wherein the support structure further includes a first coupling portion that moves the wiper blade toward the printhead to accommodate any spacing variations of an installed printhead from a nominal spacing distance, a second coupling portion that tilts the wiper blade to accommodate any tilting of an installed printhead from a nominal planar orientation, an arm having proximate and distal ends, a sled that joins the arm to the printing mechanism frame, wherein the first coupling portion joins the proximate end of the arm to the sled and the second coupling portion joins the distal end of the arm to the wiper blade; and a biasing element coupled to the support structure and the printing mechanism frame to push the wiper into engagement with the printhead.

7. An inkjet printing mechanism, comprising:

a frame;

an inkjet printhead mounted to the frame for reciprocal movement across a printzone for printing and across a servicing region for cleaning;

an upright wiper blade;

a support structure joining the wiper blade to the frame for a rocking motion of the blade with respect to the frame, wherein the support structure further includes a first coupling portion that moves the wiper blade toward the printhead to accommodate any spacing variations of the printhead from a nominal spacing distance, a second coupling portion that tilts the wiper blade to accommodate any tilting of the printhead from a nominal planar orientation, an arm having proximate and distal ends, and a sled that joins the arm to the frame, wherein the first coupling portion joins the proximate end of the arm to the sled, and the second coupling portion joins the distal end of the arm to the wiper blade; and a biasing element coupled to the support structure and the frame to push the wiper into engagement with the printhead for cleaning.

8. A wiping apparatus for cleaning an inkjet printhead installed in an inkjet printing mechanism having a frame, comprising:

an upright wiper blade, wherein the wiper blade includes a blade portion with two opposing side surfaces which define a first distance therebetween, and a base portion integrally formed with the blade portion, with the base portion having a width that is wider than the first distances;

a support structure joining the wiper blade to the printing mechanism frame for a rocking motion of the blade with respect to the frame; and a biasing element coupled to the support structure and the printing mechanism frame to push the wiper into engagement with the printhead.

9. A wiping apparatus for cleaning an inkjet printhead installed in an inkjet printing mechanism having a frame, comprising:

an upright wiper blade;

a support structure joining the wiper blade to the printing mechanism frame for a rocking motion of the blade with respect to the frame, wherein the support structure further includes an arm having proximate and distal ends, a sled that joins the arm to the printing mechanism frame, a first coupling portion that join; the proximate end of the arm to the sled to move wiper blade toward the printhead to accommodate any spacing variations of an installed printhead from a nominal spacing distance, and a second coupling portion that joins the distal end of the arm to the wiper blade to tilt the wiper blade to accommodate any tilting of an installed printhead from a nominal planar orientation; and a biasing element coupled to the support structure and the printing mechanism frame to push the wiper into engagement with the printhead, wherein the biasing element is coupled to the support structure between the first coupling portion and the second coupling portion; and wherein the wiper blade has a blade portion with two opposing side surfaces which taper into a peaked wiping edge that engages the printhead, with the wiper blade remaining substantially upright when pushed into engagement with the printhead, and with the two opposing side surfaces defining a first distance therebetween, the wiper blade further including a base portion integrally formed with the blade portion, with the base portion having a width that is wider than the first distance.

10. A servicing apparatus for maintaining an inkjet printhead installed in an inkjet printing mechanism having a frame, comprising:

a sled coupled to the printing mechanism frame to selectively service the printhead;

a wiper to wipe the installed inkjet printhead; and a wiper support structure pivoted to the sled and pivoted to the wiper to selectively wipe the printhead with the wiper.

11. A servicing apparatus according to claim 10 further including a biasing member coupled to the sled and support structure to push the support structure toward the printhead, with the biasing member being stressed when the wiper wipes the printhead.

12. A servicing apparatus according to claim 11 wherein the biasing member is coupled to the support structure between a first location where the wiper support structure is pivoted to the sled and a second location where the wiper support structure is pivoted to the wiper.

13. A servicing apparatus according to claim 11 wherein:

the sled includes a stop member;

the wiper has a stop engagement member; and the biasing member pushes the support structure toward the sled until the wiper stop engagement member engages the sled stop member.

14. A servicing apparatus for maintaining an inkjet printhead installed in an inkjet printing mechanism having a frame, comprising:

a sled coupled to the printing mechanism frame for movement from a rest position to a wiping position;

a support arm having proximate and distal ends, with the proximate end pivoted to the sled; and a wiper pivoted to the support arm distal end to engage and wipe the printhead when the sled is moved into the wiping position.

15. A servicing apparatus according to claim 14 wherein:

the inkjet printhead is installed in the inkjet printing mechanism to reciprocate along a scanning axis;

the support arm is pivoted to the sled for pivotal motion in a pivot plane;

the wiper is also pivoted to the support arm for pivotal motion in the pivot plane; and the pivot plane intersects the scanning axis.

16. A servicing apparatus according to claim 15 wherein the pivot plane is substantially perpendicular to the scanning axis.

17. A servicing apparatus according to claim 14, wherein the wiper includes:

a wiper blade; and a stem portion having a base pivoted to the support arm, and a blade support portion that supports the wiper blade.

18. A servicing apparatus according to claim 17, wherein the wiper blade comprises an upright structure that remains at a substantially constant angle with respect to the stem portion when the wiper engages and wipes the printhead.

19. A servicing apparatus according to claim 18, wherein the wiper further includes a base portion integrally formed with the wiper blade of an elastomeric material having a durometer on the Shore A scale selected in the range of 85–95.

20. A servicing apparatus according to claim 17, wherein:

the sled has a stem stop member; and the stem portion has a stop engagement member that engages the sled stem stop member when the sled is in the rest position.

21. A servicing apparatus according to claim 18, further including a biasing member coupled to the sled and support arm to urge the support arm toward the sled when the sled is in the rest position, with the biasing member being stressed when the wiper engages and wipes the printhead.

22. A servicing apparatus according to claim 21 wherein:

the sled defines a retainer connection portion;

the support arm defines a retainer aperture;

the servicing apparatus further includes a biasing member retainer coupled to the sled retainer connection portion, and slidably received within the support arm retainer aperture, with the retainer having a base; and the biasing member is restrained by the support arm and retainer base.

23. A servicing apparatus according to claim 22 wherein the biasing member retainer pivots in attachment to the sled retainer connection portion.

24. A servicing apparatus according to claim 14 wherein:

the sled is also coupled to the printing mechanism frame for movement from to a capping position; and the servicing apparatus further includes a cap supported by the sled to engage and seal the printhead when the sled is moved into the capping position.

25. A servicing apparatus according to claim 14 wherein:

the sled is also coupled to the printing mechanism frame for movement from to a capping position;

the servicing apparatus further includes a cap supported by the sled to engage and seal the printhead when the sled is moved into the capping position; and the wiper includes a wiper blade and a stem portion, with the stem portion having a base pivoted to the support arm and a blade support portion that supports the wiper blade, and with the wiper blade comprising an upright structure that remains at a substantially constant angle with respect to the stem portion when the wiper engages and wipes the printhead.

26. A servicing apparatus according to claim 25 wherein:

the sled has a stem stop member, and the sled defines a retainer connection portion;

the support arm defines a retainer aperture;

the stem portion has a stop engagement member that engages the sled stem stop member when the sled is in the rest position;

the servicing apparatus further includes:

a biasing member retainer coupled to the sled retainer connection portion, and slidably received within the support arm retainer aperture, with the retainer having a base; and a biasing member restrained by the support arm and retainer base to urge the support arm toward the sled when the sled is in the rest position, with the biasing member being stressed when the wiper engages and wipes the printhead.

27. An inkjet printing mechanism, comprising:

a frame;

an inkjet printhead mounted to the frame for reciprocal movement across a printzone for printing and across a servicing region for cleaning;

an upright wiper blade, wherein the wiper blade has a blade portion with two opposing side surfaces which taper into a peaked wiping edge that engages the printhead;

a support structure joining the wiper blade to the frame for a rocking motion of the blade with respect to the frame; and a biasing element coupled to the support structure and the frame to push the wiper into engagement with the printhead for cleaning.

28. An inkjet printing mechanism according to claim 27, wherein the support structure joins the wiper blade to the frame for a rocking motion which is substantially planar.

29. An inkjet printing mechanism according to claim 27, wherein the support structure further includes:

a first coupling portion that moves the wiper blade toward the printhead to accommodate any spacing variations of the printhead from a nominal spacing distance; and a second coupling portion that tilts the wiper blade to accommodate any tilting of the printhead from a nominal planar orientation.

30. An inkjet printing mechanism according to claim 29, wherein the biasing element is coupled to the support structure between the first coupling portion and the second coupling portion.

* * * * *

UNITED STATES PATENT AND TRADEMARK OFFICE

CERTIFICATE OF CORRECTION

PATENT NO. : 5,745,133

DATED : April 28, 1998

INVENTOR(S) : Hendricks et al.

It is certified that error appears in the above-identified patent and that said Letters Patent is hereby corrected as shown below:

Column 3 (line 2), after "7" delete ",".

Column 7 (line 67), delete "hat" and insert therefor -- that --.

Column 8 (line 1), after "of", insert -- a --.

In the Claims

Column 10 (line 12), after "engages" delete ";".

Column 11 (line 26), delete "distances" and insert therefor -- distance --.

Column 11 (line 43), delete "join;" and insert therefor -- joins --.

Signed and Sealed this

Twenty-fourth Day of November, 1998

Bruce Lehman

*Attest:*

BRUCE LEHMAN

*Attesting Officer*

*Commissioner of Patents and Trademarks*